US011111830B2

(12) United States Patent
Kringels

(10) Patent No.: US 11,111,830 B2
(45) Date of Patent: Sep. 7, 2021

(54) INTERNAL COMBUSTION ENGINE

(71) Applicant: DEUTZ AKTIENGESELLSCHAFT, Cologne (DE)

(72) Inventor: Matthias Kringels, Bornheim (DE)

(73) Assignee: Deutz Aktiengesellschaft, Cologne (DE)

( * ) Notice: Subject to any disclaimer, the term of this patent is extended or adjusted under 35 U.S.C. 154(b) by 0 days.

(21) Appl. No.: 16/467,838

(22) PCT Filed: Nov. 8, 2017

(86) PCT No.: PCT/EP2017/001297
§ 371 (c)(1),
(2) Date: Dec. 4, 2019

(87) PCT Pub. No.: WO2018/114026
PCT Pub. Date: Jun. 28, 2018

(65) Prior Publication Data

US 2020/0191029 A1 Jun. 18, 2020

(30) Foreign Application Priority Data

Dec. 20, 2016 (DE) ..... 102016015111.0

(51) Int. Cl.
*F01M 11/02* (2006.01)
*F01M 13/04* (2006.01)
*F01M 11/00* (2006.01)

(52) U.S. Cl.
CPC .... *F01M 13/0416* (2013.01); *F01M 11/0004* (2013.01); *F01M 11/02* (2013.01); *F01M 2011/023* (2013.01); *F01M 2013/0444* (2013.01); *F01M 2013/0494* (2013.01)

(58) Field of Classification Search
CPC .... F01M 11/02; F01M 13/04; F01M 11/0004; F01M 2011/0033; F01M 13/0416; F01M 2011/023
See application file for complete search history.

(56) References Cited

U.S. PATENT DOCUMENTS 4,602,595 A 7/1986 Aoki et al.
5,975,065 A 11/1999 Clauss et al.
6,029,638 A * 2/2000 Funai ..... F01M 1/12 123/572
6,196,206 B1 * 3/2001 Bedkowski ..... F01M 13/022 123/572

(Continued)

FOREIGN PATENT DOCUMENTS

DE 3122851 A1 12/1982
DE 3128470 1/1983

(Continued)

OTHER PUBLICATIONS

ISR of PCT/EP2017/001297, dated Feb. 26, 2018.

*Primary Examiner* — Long T Tran
(74) *Attorney, Agent, or Firm* — Davidson, Davidson & Kappel, LLC

(57) ABSTRACT

The invention describes an internal combustion engine having at least one crankcase, at least one cylinder head, at least one cylinder head cover, at least one oil separator and at least one oil pan for collecting returning oil as well as having at least one oil return channel that connects the oil separator and the oil pan.

19 Claims, 2 Drawing Sheets

(56) References Cited

U.S. PATENT DOCUMENTS

| | | | | |
|---|---|---|---|---|
| 6,199,543 | B1 * | 3/2001 | Bedkowski | F01M 13/04 123/572 |
| 9,416,695 | B2 | 8/2016 | Brand et al. | |
| 2001/0039908 | A1 * | 11/2001 | Bilek | F01L 1/02 114/55.5 |
| 2003/0051680 | A1 * | 3/2003 | Ito | F01M 13/0416 123/41.86 |
| 2007/0215128 | A1 * | 9/2007 | Yonebayashi | F01M 13/0416 123/572 |
| 2008/0011264 | A1 * | 1/2008 | Kawamura | F01M 13/0416 123/196 R |
| 2008/0196364 | A1 | 8/2008 | Brand et al. | |
| 2011/0167774 | A1 | 7/2011 | Herman et al. | |
| 2016/0265404 | A1 * | 9/2016 | Fujii | F01M 13/0416 |
| 2017/0175601 | A1 * | 6/2017 | Usa | F02F 1/24 |

FOREIGN PATENT DOCUMENTS

| | | | |
|---|---|---|---|
| DE | 3128470 | A1 | 1/1983 |
| DE | 19703771 | | 6/1998 |
| DE | 19715061 | C2 | 10/1998 |
| DE | 10119924 | B4 | 10/2002 |
| DE | 102004019853 | A1 | 11/2004 |
| DE | 102004012160 | A1 | 9/2005 |
| DE | 102004041110 | | 3/2006 |
| DE | 102007008672 | | 9/2008 |
| DE | 102008058920 | A1 | 5/2010 |
| DE | 102013212104 | | 1/2015 |
| JP | H06123212 | A | 5/1994 |

* cited by examiner

INTERNAL COMBUSTION ENGINE

The invention relates to an internal combustion engine having a centrally arranged oil return line.

BACKGROUND

Such internal combustion engines are known, for example, from German patent specification DE 197 15 061 C2, which describes a venting device for the crankcase of an internal combustion engine to which a cylinder head is attached that is covered by a cylinder head cover, whereby the venting device has an oil separator that is essentially integrated into the cylinder head cover and that is provided with baffles, said oil separator being formed by a top part that is joined to the cylinder head cover in one piece and by a bottom part, whereby the oil separator has in inlet, an intake manifold that is connected to the intake system of the internal combustion engine as well as an oil outlet, and whereby the baffles of the oil separator are formed by webs in the top part.

Moreover, German patent DE 101 19 924 B4 discloses an internal combustion engine for a motor vehicle, comprising an oil conveying means to supply oil to lubrication points, whereby an oil pan is provided for collecting returning oil, whereby the oil pan has a separation device that divides the oil pan into a first and a second section, whereby a device is provided for wet sump lubrication with a wet sump circuit that is connected to the first section, and a device for dry sump lubrication with a dry sump circuit that is connected to the second section, whereby the separation device has a non-return valve that opens in the direction of the first section that has the wet sump lubrication.

Moreover, German patent application DE 31 28 470 A1 discloses a cyclone separator that is used to vent the crankcase of internal combustion engines and that has an inlet nozzle for the oil-laden crankcase air, said inlet nozzle opening up tangentially into a cyclone chamber in the separator housing, whereby the cross section of the inlet nozzle can be changed in order to generate an optimal pressure gradient or in order to achieve an optimal separation.

German patent application DE 31 22 851 A1 discloses a crankcase ventilation system of an internal combustion engine, comprising a pot-shaped container that is supported on the rocker arm bracket in the valve chamber and that is closed towards the top vis-à-vis the valve housing cover by means of an elastic gasket situated in-between, whereby, on the one hand, the space inside the container is connected to the intake system of the internal combustion engine via the housing cover and, on the other hand, it is connected to the valve chamber or to the crankcase via an opening arranged on the opposite side.

SUMMARY OF THE INVENTION

An objective of the present disclosure is reliably ensuring the return of oil in an internal combustion engine, even in the case of a slanted position.

An internal combustion engine is provided that has at least one crankcase, at least one cylinder head, at least one cylinder head cover, at least one oil separator and at least one oil pan for collecting returning oil as well as having at least one oil return channel that connects the oil separator and the oil pan.

Furthermore, it is provided according to an embodiment of the invention for the oil separator to be arranged in the cylinder head cover.

In another embodiment according to the invention, the oil separator has a partition facing the clean air part.

In an embodiment according to the invention, it is provided for the oil return channel to be arranged at the lower end of the oil separator.

Moreover, it is provided according to an embodiment of the invention for the oil return channel to be arranged in the middle below the oil separator.

Another embodiment according to the invention provides for the oil return channel to lead from the cylinder head cover into the cylinder head via at least one joining piece or axial gasket.

In another embodiment according to the invention, it is provided that, after the oil return channel enters the cylinder head, it runs at a slant outwards in the direction of a cylinder head screw and around it.

In another embodiment according to the invention, it is provided for the oil return channel to be part of the cylinder head gasket so that the cylinder head gasket acquires oil-conveying properties.

Moreover, it is provided according to an embodiment of the invention for the oil return channel below the cylinder head gasket to be in the form of a groove created in the pipe part contour of the crankcase and for said oil return channel to make a transition to a pipe cross section that runs essentially perpendicularly in the direction of the oil pan.

Another embodiment according to the invention provides for the end of the oil return channel to be fitted with a non-return valve.

BRIEF SUMMARY OF THE DRAWINGS

The invention is described in greater detail on the basis of an embodiment and making reference to the drawings. The following is shown.

DETAILED DESCRIPTION

Figure 1:
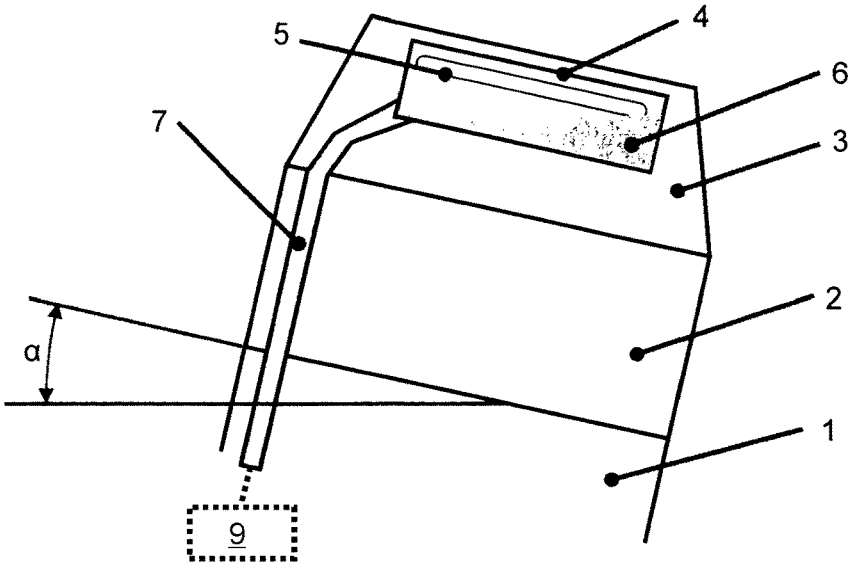
FIG. 1 an internal combustion engine at a maximum slanted position α and with one oil return channel, FIG. 2 an internal combustion engine at a maximum slanted position a and with two oil return channels, FIG. 3 an internal combustion engine with an oil return channel arranged in the middle and at a slanted position β, FIG. 4 a non-return valve is arranged at the lower end of the oil return channel, FIG. 5 a drain through the cylinder head and crankcase bores.

FIG. 1 shows an internal combustion engine at a maximum slanted position α and with one oil return channel 7. The internal combustion engine has a crankcase 1, a cylinder head 2 and a cylinder head cover 3 which is arranged over the cylinder head 2 and in which an oil separator 4 is arranged that has a partition 5 facing the clean air part. The separated oil 6 is held in the oil separator 4 at the defined slanted position angle α in such a way that it just barely cannot overflow out of the oil separator 4. The oil return channel 7 is arranged at the lower end of the oil separator and it runs on the outside of the internal combustion engine to the oil pan 9.

Figure 2:
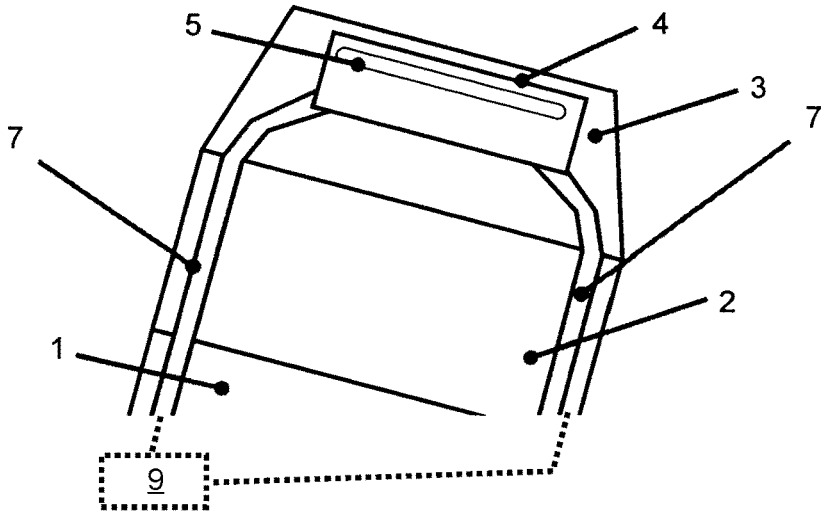

FIG. 2 shows an internal combustion engine at a maximum slanted position a and with two oil return channels 7. The internal combustion engine has a crankcase 1, a cylinder head 2 and a cylinder head cover 3 which is arranged over the cylinder head 2 and in which an oil separator 4 is arranged that has a partition 5 facing the clean air part. The separated oil 6 is held in the oil separator 4 at the defined slanted position angle α in such a way that it just barely cannot overflow out of the oil separator 4. The oil return channels 7 are each arranged at the lower end of the oil separator and they run on the outside of the internal combustion engine to the oil pan 9.

Figure 3:
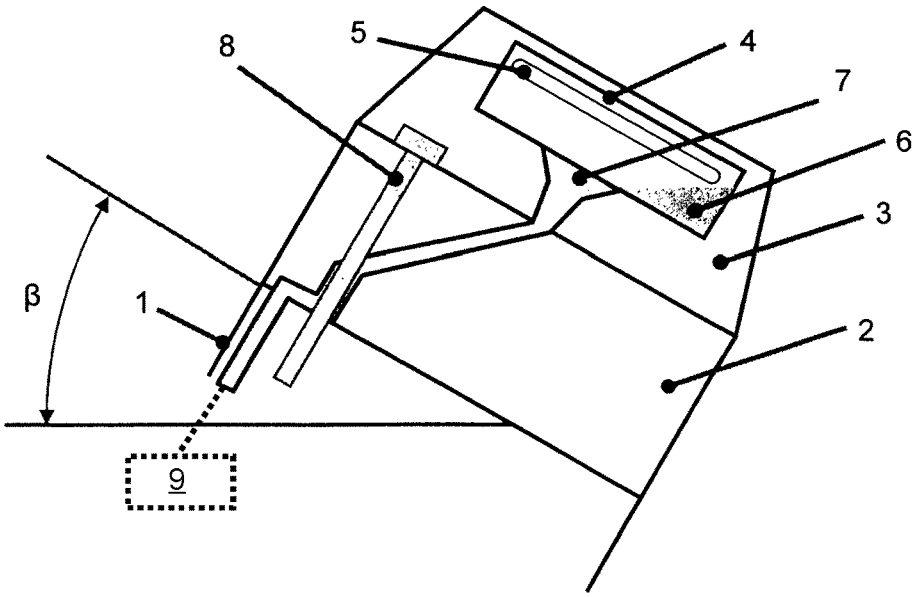
Figure 4:
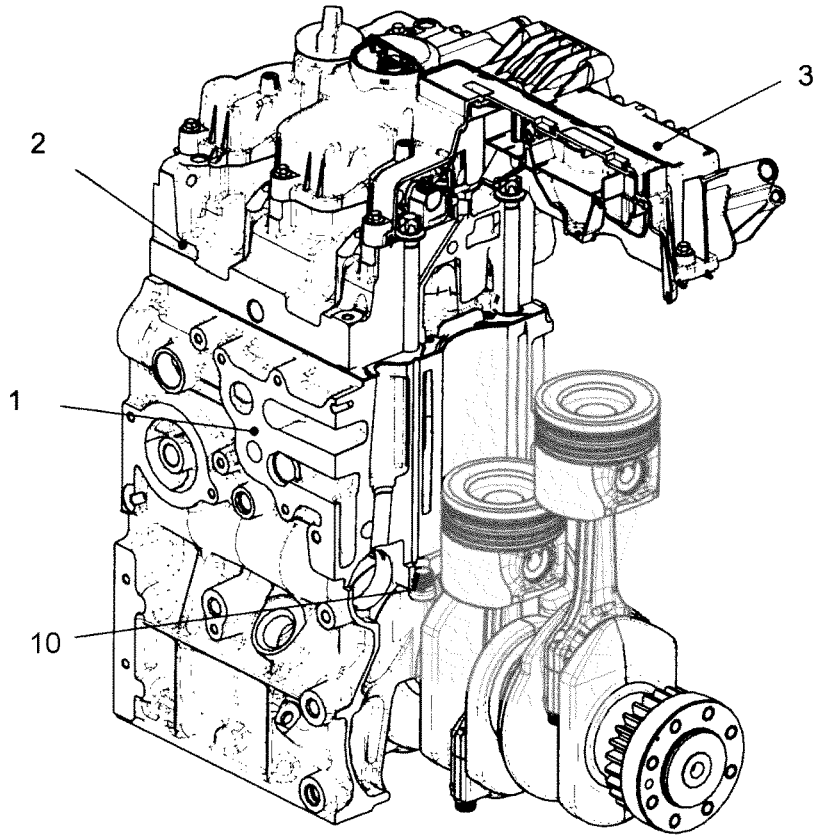

FIG. 3 shows an internal combustion engine at a maximum slanted position β and with one oil return channel 7, whereby the angle β is greater than the angle α. The internal combustion engine has a crankcase 1, a cylinder head 2 and a cylinder head cover 3 which is arranged over the cylinder head 2 and in which an oil separator 4 is arranged that has a partition 5 facing the clean air part. The separated oil 6 is held in the oil separator 4 at the defined slanted position angle β in such a way that it just barely cannot overflow out of the oil separator 4. The oil return channel 7 is arranged in the middle below the oil separator and it runs from the middle of the cylinder head 2 in the direction of the cylinder head screw 8 on the outside of the internal combustion engine to the oil pan 9 in such a way that, in a partial area, the returning oil flows around the cylinder head screw 8, whereby, in the area of the cylinder head gasket 12 (FIG. 5), the returning oil is carried away from the cylinder head screw and to the wall of the crankcase, for example, in a groove created in the crankcase 1 for this purpose. As shown in FIG. 4, a non-return valve 10 is arranged at the lower end of the oil return channel 7.

Figure 5:
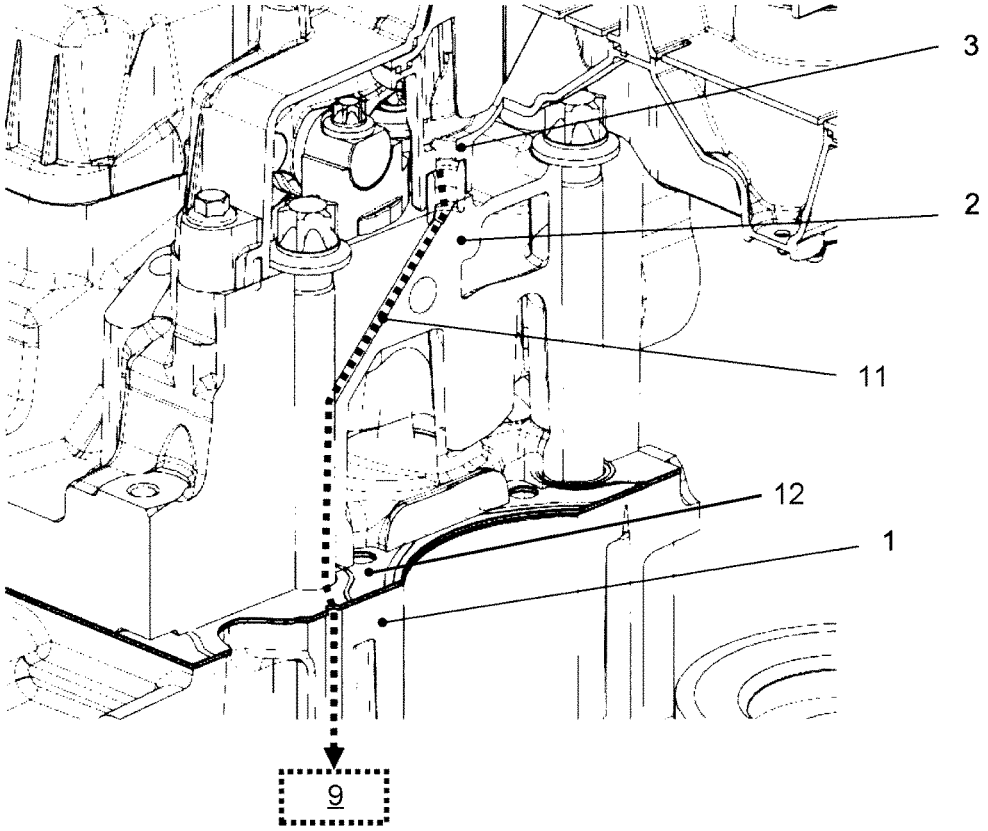

FIG. 5 shows a drain 11 through the cylinder head and crankcase bores.

LIST OF REFERENCE NUMERALS

1 crankcase
2 cylinder head
3 cylinder head cover
4 oil separator
5 partition facing the clean air part
6 separated oil
7 oil return channel
8 cylinder head screw
9 oil pan
10 non-return valve
11 drain through the cylinder head and crankcase bores
12 cylinder head gasket

What is claimed is:

1. An internal combustion engine comprising:
a crankcase;
a cylinder head;
a cylinder head cover;
an oil separator; and
an oil pan for collecting returning oil as well as having an oil return channel that connects the oil separator and the oil pan, a top end of the oil return channel being slanted at an intersection with a lower end of the oil separator to align the top end of the oil return channel with a surface of the oil in the oil separator when the internal combustion engine is in a slanted position.

2. The internal combustion engine according to claim 1 wherein the oil separator is arranged in the cylinder head cover.

3. The internal combustion engine according to claim 1 wherein the oil separator has a partition facing a clean air part.

4. The internal combustion engine according to claim 1 wherein the oil return channel is arranged in a middle below the oil separator.

5. The internal combustion engine according to claim 1 wherein the oil return channel leads from the cylinder head cover into the cylinder head via at least one joining piece or axial gasket.

6. The internal combustion engine according to claim 1 wherein the oil return channel is part of a cylinder head gasket so that the cylinder head gasket acquires oil-conveying properties.

7. The internal combustion engine according to claim 6 wherein the oil return channel below the cylinder head gasket is in the form of a groove created in a pipe part contour of the crankcase and the oil return channel makes a transition to a pipe cross section that runs essentially perpendicularly in a direction of the oil pan.

8. The internal combustion engine according to claim 1 wherein an end of the oil return channel is fitted with a non-return valve.

9. The internal combustion engine according to claim 1 wherein a portion of the oil return chancel that is slanted is in the cylinder head cover.

10. The internal combustion engine according to claim 1 wherein the top end of the oil return channel extends from a corner of the oil separator.

11. The internal combustion engine according to claim 1 further comprising a further oil return channel, a top end of the further oil return channel being slanted at a further intersection with the lower end of the oil separator to align the top end of the further oil return channel with the surface of the oil in the oil separator when the internal combustion engine is in a further slanted position opposite of the slanted position.

12. The internal combustion engine according to claim 11 wherein a portion of the further oil return chancel that is slanted is in the cylinder head cover.

13. The internal combustion engine according to claim 11 wherein the top end of the further oil return channel extends from a further corner of the oil separator.

14. The internal combustion engine according to claim 1 wherein the oil return channel includes a further slanted portion beginning at a top of the cylinder head.

15. The internal combustion engine according to claim 14 wherein the further slanted portion ends at a cylinder head screw and the oil return channel changes course.

16. The internal combustion engine according to claim 15 wherein the cylinder head screw extends entirely through the cylinder head and into the crankcase.

17. The internal combustion engine according to claim 1 wherein the oil return channel extends horizontally along a top of the crankcase.

18. The internal combustion engine according to claim 1 wherein the top end of the oil return channel is slanted in two opposite directions such that oil return channel converges as the oil return channel extends downward from the lower end of the oil separator to align the top end of the oil return channel with the surface of the oil in the oil separator when the internal combustion engine is in the slanted position and a further slanted position opposite of the slanted position.

19. An internal combustion engine comprising:
a crankcase;
a cylinder head;
a cylinder head cover;
an oil separator; and
an oil pan for collecting returning oil as well as having an oil return channel that connects the oil separator and the oil pan, wherein, after the oil return channel enters the cylinder head, the oil return channel runs at a slant outwards into a cylinder head screw and around the cylinder head screw.

* * * * *